United States Patent [19]

May

[11] 4,427,393

[45] Jan. 24, 1984

[54] PROPULSION OF SHIPS

[75] Inventor: Eric R. May, Sevenoaks, England

[73] Assignee: Vickers Public Limited Company, London, England

[21] Appl. No.: 313,692

[22] Filed: Oct. 21, 1981

[30] Foreign Application Priority Data

Oct. 24, 1980 [GB] United Kingdom ..... 8034420

[51] Int. Cl.[3] ..... B63H 5/16

[52] U.S. Cl. ..... 440/67; 440/71; 416/247 A; 60/221

[58] Field of Search ..... 440/66, 67, 71, 72; 114/40, 43, 151, 57, 166; 416/247 A, 247 R; 60/221

[56] References Cited

U.S. PATENT DOCUMENTS

| | | | |
|---|---|---|---|
| 1,065,089 | 6/1913 | Wabo | 440/67 |
| 3,261,544 | 7/1966 | Guichard | 416/247 |
| 3,389,558 | 6/1968 | Hall | 60/221 |
| 3,457,891 | 7/1969 | Clark et al. | 114/166 |
| 4,070,984 | 1/1978 | Kappas | 440/72 |
| 4,106,425 | 8/1978 | Gruber | 440/72 |
| 4,182,118 | 1/1980 | Chronic | 60/221 |
| 4,309,172 | 1/1982 | Narita et al. | 440/67 |

FOREIGN PATENT DOCUMENTS

| | | | |
|---|---|---|---|
| 2939091 | 4/1980 | Fed. Rep. of Germany | 440/72 |
| 1409346 | 10/1975 | United Kingdom | 440/71 |
| 388958 | 11/1973 | U.S.S.R. | 440/71 |

*Primary Examiner*—Trygve M. Blix
*Assistant Examiner*—Stephen P. Avila
*Attorney, Agent, or Firm*—Pollock, Vande Sande and Priddy

[57] ABSTRACT

Propulsion unit for a marine vessel intended for operation under severe ice conditions comprises a multi-bladed propeller, which may be of fixed or controllable pitch, a stationary duct, which may take the form of a nozzle, within which the propeller runs and is protected peripherally against ice damage, and, at the forward and aft ends of the duct, water-guide members in the form of vanes and/or blades which are more massive than is required by their water-guiding functions and which restrict the size of ice masses that can encounter the propeller by entering the duct at its opposing ends. The duct may embrace the propeller peripherally around the full 360°. The water-guide members may be secured at their outer ends to the duct and at their inner ends to ring members co-axial with the propeller. The upper quadrant of the duct may be secured to the hull of the vessel and the lowest portion of the duct to a skeg extending beneath the duct.

3 Claims, 4 Drawing Figures

PROPULSION OF SHIPS

BACKGROUND OF THE INVENTION

This invention concerns improvements relating to the propulsion of ships, particularly icebreakers and other vessels used in severe ice conditions, whether for transportation or, say, for arctic exploration.

There is ample experience of ice damage to both fixed-pitch and controllable-pitch propellers fitted to ships operating in heavy ice. This is true even of such propellers which are arranged to operate in nozzles with the object of increasing the so-called "bollard pull" of the vessel at the expense, generally, of a reduction in free running speed.

It is desirable for reasons of propulsive efficiency and maximum thrust when icebreaking that a single propeller be fitted on the centerline of the vessel at a maximum depth of immersion consistent with the ship's keel line, but if a single propeller so fitted is badly damaged by ice, the ship may be immobilized in a geographically remote area. Consequently, partly because of this risk, it is common practice to fit more than one propeller to icebreakers.

If it is possible to fit guards, fore and aft of a nozzle propeller, of sufficient scantlings to keep out large masses of ice and to make the nozzle itself of adequate strength, then it can be postulated that a single propeller be used for the purpose with very much less risk of the ship being disabled by ice. Similar protection would also be desirable for each propeller of a multi-propeller installation. It was, however, to be expected that such guards would reduce propulsive efficiency.

SUMMARY OF THE INVENTION

It is an object of the present invention to provide propulsion means by which protection can be achieved together with hydrodynamic advantage, that is with enhanced propulsive efficiency, including additional bollard pull available as ice-breaking thrust.

According to the invention, the or each propulsion means for a marine vessel intended for operation under severe ice conditions comprises a multi-bladed propeller, of either fixed or controllable pitch, which runs within, and is protected peripherally against ice damage by, a stationary nozzle or duct and massive water-guide vanes and/or blades, at the forward and aft ends of the nozzle or duct, which restrict the size of ice masses that can encounter the propeller by entering the nozzle or duct at the said ends.

The nozzle or duct may embrace the propeller peripherally around the full 360° or around a smaller proportion of the periphery.

In addition to being secured above to the hull, the nozzle or duct may also be secured below to a skeg, particularly in the case of single-propeller installations in which a skeg is likely to be present in any case.

Advantageously, the aforesaid vanes or blades consist of water-inlet guide vanes at the forward end of the nozzle or duct and stator blades at the aft end thereof. The vanes and/or blades may be secured to the nozzle and/or to the hull of the vessel. The stator blades may be secured at their inner ends to a ring member coaxial with the propeller.

BRIEF DESCRIPTION OF THE DRAWINGS

One form of embodiment of the invention will now be more fully described with reference to the accompanying diagrammatic drawing, in which.

DESCRIPTION OF THE PREFERRED EMBODIMENTS

Figure 3:
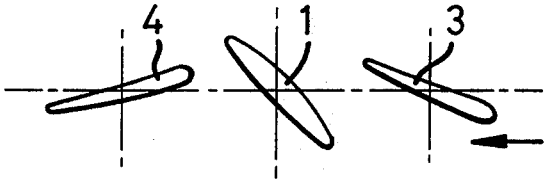
FIG. 3 is a diagrammatic illustration showing the ends of a guide vane, a propeller blade and a stator blade, each as seen end-on radially.

Referring to the drawing, the propulsion means comprises a single multi-blade variable-pitch propeller 1 operating within a stationary nozzle 2 which subtends the full 360° around the propeller. The nozzle 2 is provided, forward, with robust inlet guide vanes 3 of cast steel and, aft, with robust stator blades 4. The vanes 3 serve the dual purposes of, by virtue of their shape, guiding the water entering the propeller, when the vessel is going ahead, in such manner as is most advantageous for propulsive efficiency, and of diverting large masses of ice away from the nozzle 2 and the blades of the propeller 1. The blades 4 serve the dual purpose of, by virtue of their shape, regaining energy from the propeller wake to increase propulsive efficiency by converting energy in the said wake into thrust when the vessel is going ahead, and of diverting large masses of ice away from the nozzle 2 and the propeller blades when the vessel is going astern. As mentioned in the brief description of the drawings, FIG. 3 shows an end-on radial view of a blade of the propeller 1, a forward guide vane 3 and an aft stator blade 4. Accordingly, FIG. 3 illustrates how the guide vanes 3 and stator blades 4 are inclined about radially extending axes toward opposite sides of respective planes extending through and including the axis of rotation of the propeller 1.

Figure 1:
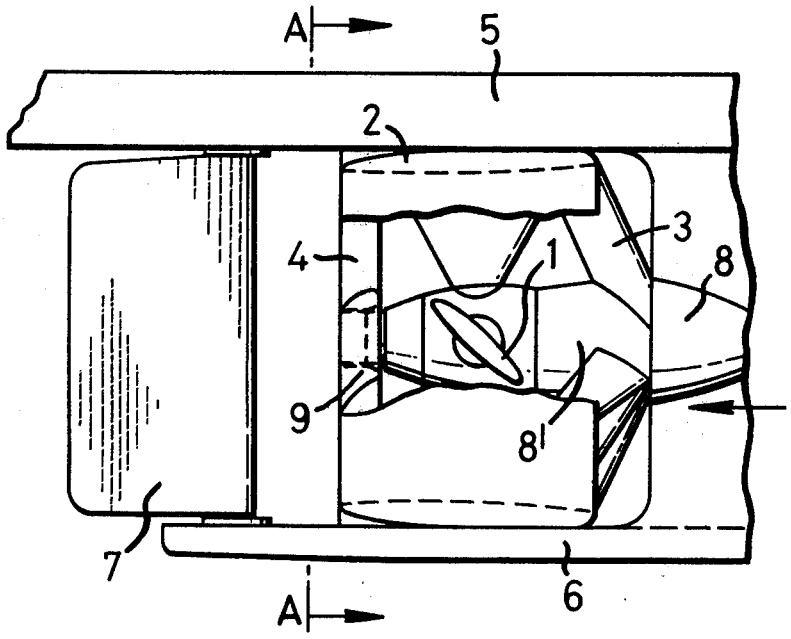
FIG. 1 is a diagrammatic side elevation, partly in section, of propulsion means for an icebreaker or other vessel for use under severe ice conditions.
Figure 2:
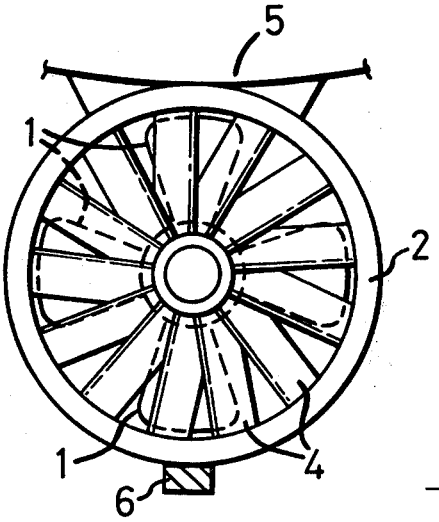
FIG. 2 is a cross section on the line A—A in FIG. 1.
Figure 4:
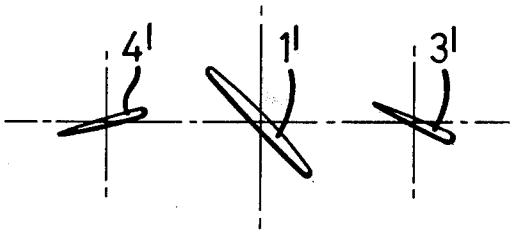
FIG. 4 is a similar diagrammatic illustration, for purposes of comparison, showing the ends of guide-vane, propeller-blade and stator-blade members as these might each be designed to serve its respective hydrodynamic purpose only.

For comparison with FIG. 3, FIG. 4 indicates the relative order of dimensions of members 1', 3' and 4' designed solely to serve their respective hydrodynamic functions without regard to additional strength required to minimize risk of serious ice damage. The members 1, 3 and 4 of FIG. 3 are markedly more massive and robust than the members 1', 3' and 4' of FIG. 4.

The nozzle 2 is secured over an adequate area of its upper quadrant to the hull 5 of the vessel and at its lowest portion to a skeg 6 extending from the hull to the lower mounting for the rudder 7. The vanes 3, extending from the propeller-shaft housing 8, are secured to the forward end of the nozzle 2. The blades 4, extending to the nozzle 2 are secured at their inner ends to a ring 9, co-axial with the propeller 1, which supports the blades in relation to one another. The vanes 3 and blades 4 are suitably thirteen or more in number for the example illustrated (a four-blade propeller of 5.2 m diameter).

With the propulsion means described above, risk of ice damage can be substantially reduced, as the propeller 1 is protected peripherally by the nozzle 2 and against ice which could encounter the propeller by entering the nozzle at the ends by the vanes 3 and blades 4 which restrict the size of ice masses which can so enter. The said blades and vanes are made adequately massive for the purpose. In addition to their protective function, however, the vanes and blades are shaped to serve their respective water-guiding functions and thus to maximize propulsive efficiency when the vessel is going ahead.

For the purpose only of illustration, assume a propeller of 150 rpm transmitting 9000 SHP running in a nozzle of about 5.2 m internal diameter, with fifteen inlet guide vanes each of about 15 cm cross section and approximately 1 m apart at the nozzle (except at the top and bottom of the aperture).

At an assumed maximum speed of advance Va of 3 m/sec. (speed Vs when icebreaking 5 m/sec.), ice to a maximum cross section of 1 m will enter between vanes at 3 m/sec., and each propeller blade in turn must cut away and shatter a 30 cm slice of ice with a shearing action. The ice will be prevented from giving appreciably to the blade edge by the vanes on either side of it.

A large mass of ice, sensibly greater than 1 m in its smallest dimension, postulates a threat to guide vanes 3 and stator blades 4 rather than propeller blades. A $10^4$ kg block of ice could, for example, strike one guide vane at 3 m/sec. or, with the lesser speed probable astern, strike one stator blade at 2 m/sec., and in either case be brought to rest in 1 m (though the guide vanes 3 are intended to deflect rather than stop heavy ice in most circumstances). In this case, a force of 52 tons will require to be applied by the cast steel guide vane, for which purpose a vane approximately 2 m in radial length will require to have a maximum-section of about 15 cm thickness and a depth of section 76 cm.

What is claimed is:

1. A propulsion unit for a marine vessel intended to operate under severe ice conditions, comprising a multi-bladed propeller, a stationary duct that embraces said propeller peripherally around the full 360° and within which said propeller runs and is protected against ice damage, massive water-inlet guide vanes and stator blades at the forward and aft ends of said duct respectively, said guide vanes and stator blades being inclined at angles to respective planes extending through the axis of rotation of said propeller and being inclined toward opposite sides of said planes fore and aft of said propeller thereby to increase the propulsive efficiency, and said guide vanes and stator blades having strength and dimensions adequate to divert large masses of ice away from said propeller and to restrict the size of ice masses that can encounter said propeller by entering said duct at said ends thereof, a ring member at the aft end of said duct coaxial with said propeller to which inner ends of said stator blades are secured, and a further structure coaxial with said propeller at the forward end of said duct to which the inner ends of said guide vanes are secured, said stator blades and guide vanes extending from their said inner ends to said duct.

2. A marine vessel comprising propulsion means according to claim 1, wherein the upper quadrant of the said duct is secured to the hull of the vessel.

3. A vessel according to claim 2, wherein the lowest portion of the duct is secured to a skeg extending beneath the duct.

* * * * *